United States Patent [19]

Boaden et al.

[11] 3,983,671

[45] Oct. 5, 1976

[54] PREFABRICATED STRUCTURES FOR USE IN ELECTRICAL WIRING

[75] Inventors: Richard Henry Boaden, Mississauga; Andrew Steven Zakrzewski, Burlington, both of Canada

[73] Assignee: Dominion Foundries and Steel, Limited, Hamilton, Canada

[22] Filed: Dec. 4, 1974

[21] Appl. No.: 529,432

[30] Foreign Application Priority Data

Dec. 5, 1973 United Kingdom ..... 56377/73

[52] U.S. Cl. ..... 52/220; 52/266; 52/283; 52/288; 52/289

[51] Int. Cl.[2] ..... E04B 5/48; E04B 2/56

[58] Field of Search ..... 52/283, 289, 220, 221, 52/266, 300, 235, 241, 288; 174/48

[56] References Cited

UNITED STATES PATENTS

| | | | |
|---|---|---|---|
| 915,074 | 3/1909 | Craig | 52/283 X |
| 1,981,239 | 11/1934 | Manske | 174/48 |
| 2,104,500 | 1/1938 | Van Buren | 52/283 X |
| 2,111,634 | 3/1938 | Kotrbaty | 52/300 X |
| 2,140,771 | 12/1938 | Slayter et al. | 174/48 |
| 2,381,635 | 8/1945 | Baker | 52/241 |
| 2,387,229 | 10/1945 | Auten | 52/289 X |
| 2,631,825 | 3/1953 | Zeitler | 52/221 X |
| 3,214,888 | 11/1965 | De Ridder | 52/283 X |
| 3,217,452 | 11/1965 | Steele | 52/241 X |
| 3,255,563 | 6/1966 | Sauer | 52/221 X |
| 3,262,083 | 7/1966 | Gooding | 174/48 X |
| 3,461,349 | 8/1969 | Meyer | 174/48 X |
| 3,462,892 | 8/1969 | Meyer | 52/221 X |
| 3,624,977 | 12/1971 | Morton et al. | 52/221 |
| 3,744,199 | 7/1973 | Navarre | 52/241 X |
| 3,814,833 | 6/1974 | Yamada et al. | 174/48 |
| 3,822,522 | 7/1974 | Termohlen | 52/235 X |

FOREIGN PATENTS OR APPLICATIONS

| | | | |
|---|---|---|---|
| 1,398,457 | 6/1964 | France | 52/221 |

*Primary Examiner*—Ernest R. Purser
*Assistant Examiner*—Leslie Braun
*Attorney, Agent, or Firm*—Hirons & Rogers

[57] ABSTRACT

In a wall structure comprising parallel sole and head members and vertical stud members a wiring channel of C cross-section is fastened to the structure and constitutes a raceway for electrical wiring. The open face of the channel is closed by the sheet applied to the corresponding face of the wall member to permit the use of ordinary unarmored cable therein. A bridging channel is used to convey the cable between two walls abutting at right angles to prevent sharp bends in the cable.

2 Claims, 3 Drawing Figures

PREFABRICATED STRUCTURES FOR USE IN ELECTRICAL WIRING

Figure 1:
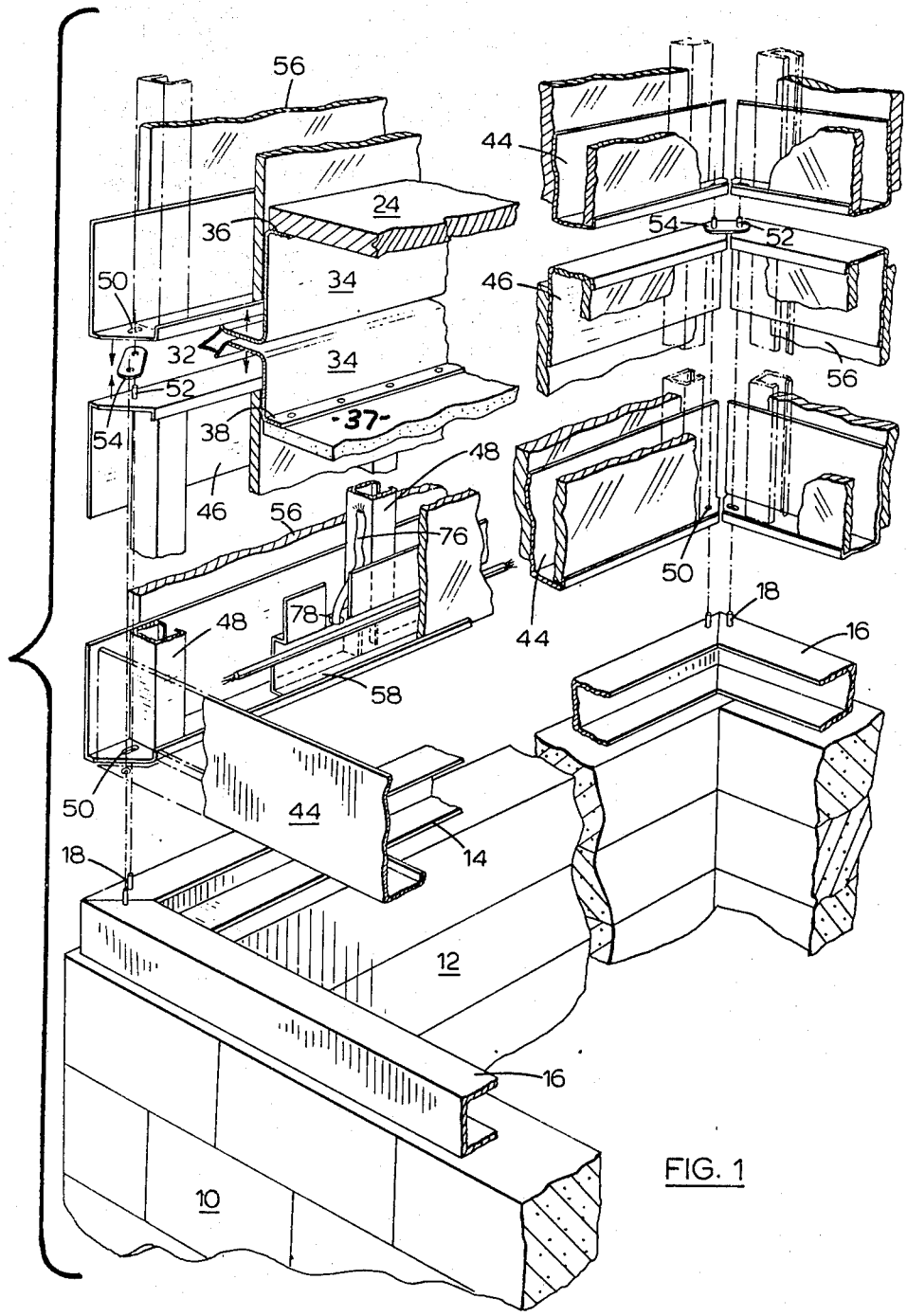

The present invention is concerned with improvements in or relating to prefabricated structures for use with electrical wiring, and especially to such structures employing prefabricated metal members.

There have been a number of proposals hitherto for prefabricated structures that will provide raceways in which otherwise unprotected electric wiring can be run while meeting the requirements of different utility codes. There is also a continuing endeavour to make use of steel in the construction of structures, especially domestic housing, in view of the shortage of suitable woods at a reasonable price. The use of steel increases the possibility of economically using prefabricated housing structures, but many of the structures proposed hitherto providing the necessary electrical raceways appear to be relatively complicated in the manner in which the prefabricated sections fit and are connected together, increasing the expense of manufacture and the difficulty of erection without the use of relatively skilled labour. The use of metal members in such structures raises a special problem with electrical wiring, since if the members are drilled or pierced to pass wires therethrough the holes must be grommetted and the subsequent threading of the wires is slow and awkward.

It is an object of the present invention to provide a new prefabricated structure employing steel members and providing a raceway for electric wiring.

It is a more specific object to provide a new prefabricated wall structure employing steel members that is particularly suited for use in domestic housing and the electric wiring thereof.

It is another specific object to provide a connecting member facilitating the passing of an electric wire between two prefabricated wall structures disposed at right angles to one another.

In accordance with the present invention there is provided a building wall structure comprising:

a. a wall frame providing an internal vertical face to which a sheet member is applied to close the frame and provide a corresponding internal wall surface;

b. the wall frame being constituted by a horizontal sole member, a spaced parallel horizontal head member, and parallel vertical stud members extending between and connecting the head and sole members;

c. a channel member having a C cross-section and mounted within the said wall frame;

d. the channel member having the lower ledge thereof fastened to the sole member and the open face of the channel opening to the said internal vertical face of the wall frame;

e. the said sheet member applied to the said wall frame internal vertical face also closing the open face of the channel so that the channel and the adjacent portion of the panel member constitute a closed raceway for electric wiring.

Preferably, the wall structure includes deck members having one or more horizontal flanges for interposition between two vertical superimposed walls of the structure, and vertically-extending flanges at the opposite sides of the horizontal flange extending vertically alongside the walls, the vertically upwardly-extending vertical flanges extending alongside the outer face of the adjacent sheet member and being of sufficient depth to overlap the open face of the channel member.

In such a wall structure the raceway channels of two wall structures abutting at right angles to one another terminate short of the respective abutting edges of the wall structures, and there is provided a bridging member for conveying electrical wiring between the two raceway channels comprising an upwardly-opening channel extending between the two wall structures at approximately 45° to each structure.

Figures 2, 3:
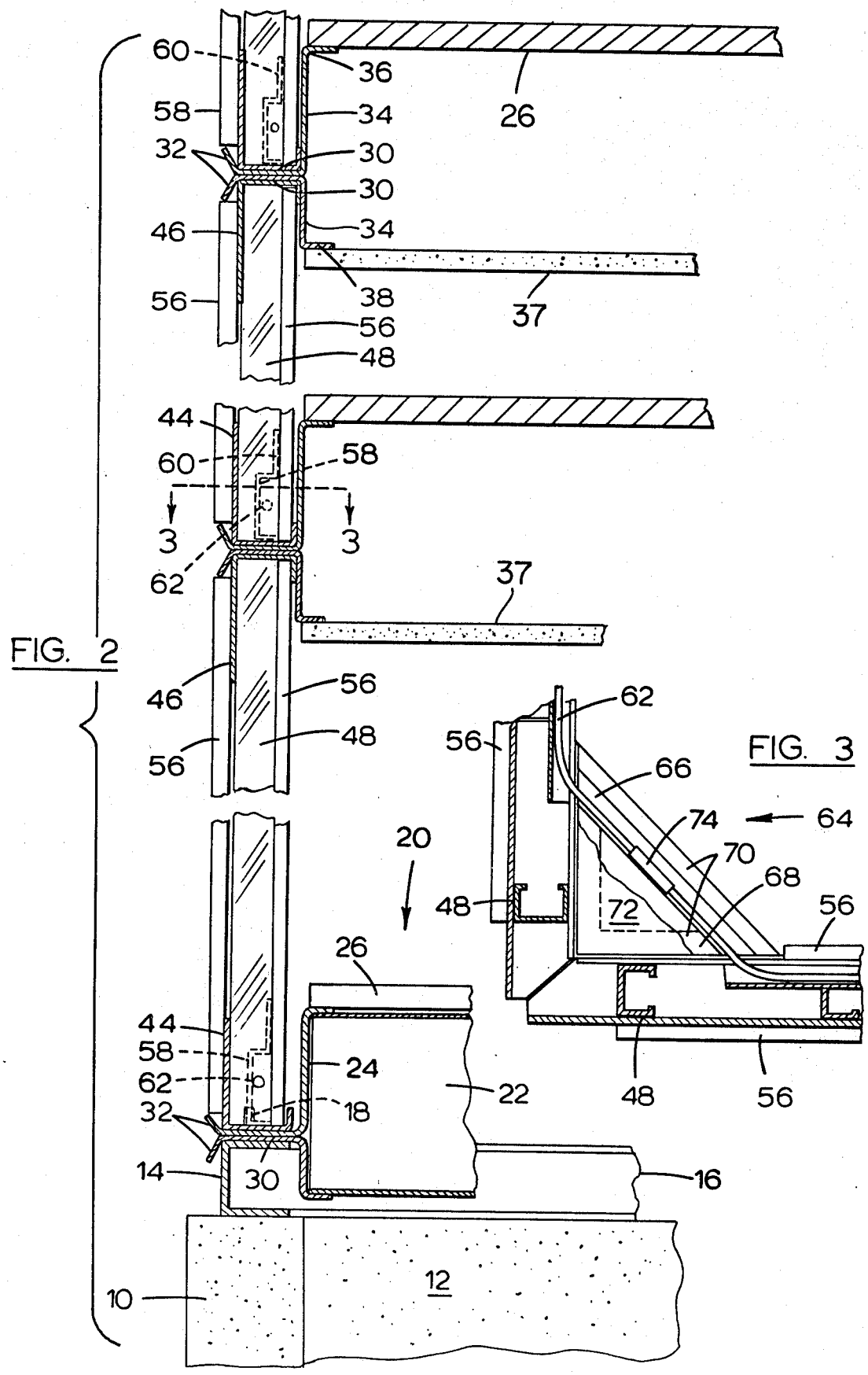

Particular preferred embodiments of the invention will now be described, by way of example, with reference to the accompanying diagrammatic drawings wherein:

FIG. 1 is a general perspective exploded view of an entire wall structure in which the invention is incorporated in order to show the spatial relationship of the wall elements to one another and the manner in which they can be fitted together, FIG. 2 is a vertical section of the wall structure of FIG. 1, and FIG. 3 is a section on the line 3—3 of FIG. 2 of a corner of the structure to show a detail.

The particular building structure illustrated has end walls 10 and side walls 12 which together form a rectangular structure on which is laid a steel framework constituted by members 14 and 16, these members being fastened to the walls and the ends of the members being secured together in any suitable manner which is not illustrated. At each corner of the framework is provided two spaced locating pins 18 extending vertically therefrom. A plurality of deck members 20 (shown in FIG. 2 only) are mounted on the framework, each deck member comprising a plurality of parallel rolled steel joist members, such as 22, joined together at their ends by headers 24 and having a sheet 26 of suitable material such as plywood fastened to the upper face thereof. Another panel may be fastened to the lower face and will then constitute a ceiling for a space below. Each vertical panel edge that is closely adjacent to a framework member 14 or 16 has a flange 30 extending horizontally therefrom, and constituting part of what is called for convenience a "head member." The outer edge of the flange is provided with upwardly and downwardly deflected lips 32.

In a particular construction of the head member the respective deck member headers, the horizontal flanges and the lips 32 are formed by two similar-shaped L-section rolled members fastened together. Thus, the sections each have a horizontal leg 30 and a vertical leg 34, the two horizontal legs being fastened together and the lips 32 extending from the free edges thereof. The vertical legs 34 lie in the same plane and are provided with respective horizontal flanges 36 and 38. The floor sheets 26 are fastened to the flanges 36, while suitable ceiling panels 37 may be fastened to the flanges 38. Each endmost deck member 20 has flanges 30 extending from its two headers at its end and from one of its side joists, while each intermediate panel has flanges extending only from its header ends. The flanges terminate at the corners to leave a square space through which the pins 18 extend. Adjacent deck members may be spaced from one another by the width of a joist spacing to avoid the wastage of "doubled" joists where they would abut, the spaces being provided with bridging pieces and closed by suitable strips.

The flanges 30 comprise a floor plate portion of the head member with the downwardly-extending lips 32 ensuring positive retention of the deck members on the beams 14 and 16. The flanges and the upwardly-extending lips 32 now provide effective channels for the reception of respective wall structures. Each wall structure comprises a wall frame constituted by an L-section sole member 44, a similar section head member 46 and C-section vertical stud members 48. The ends of members 44 and 46 are mitred so that abutting beams will form a right angle corner without overlap. One end of member 44 is provided with a round opening 50 that fits over a corresponding corner pin 18, while the other end is provided with an elongated opening, so as to fit easily over a corresponding pin 18 despite small differences in beam length due to manufacturing tolerances. The upper faces of the head members 46 are provided with vertically-extending pins 52 corresponding to the pins 18. Immediately upon placement of the wall panels their abutting edges are retained together by small flat links 54 that are slipped on to the adjacent pins 52.

The inside edges of the members 44 and 46 and the inside edges of the stud members 48 provide an internal vertical face to which wall panels 56 of a suitable material, such as wall board, can be fastened. Intermediate floor and ceiling deck members are provided, and a second set of wall structues are disposed accurately on top of the first set, by means of corresponding head members resting on the wall structures below and receiving the superimposed structures. A suitable flat roof construction may be mounted on the walls by means of another set of head members, or alternatively a gable roof structure may be used such as that described in U.S. Pat. No. 3,902,280.

An electric wiring system for use with a prefabricated wall structure makes use of a channel member 58, which is fastened to the wall panel immediately adjacent the sole member 44. More specifically, the channel member is of C-cross section with the base of the C extending vertically and the lower side leg abutting and fastened to the upper face of the sole member. The channel opens to the face of the wall frame that is the building inside wall frame face, and is positioned so that this open side is closed by the facing panels 56 to form a completely closed raceway that will meet electrical code requirements and avoid the need to enclose the wiring in a protective metal sheath. It will be seen that with the specific head member described the raceway is below the floor level, giving even more complete protection. A vertical flange 60 is provided on the free edge of the upper side leg of the channel to give adequate surface for the engagement of the panel 56. It will be noted also that the panels 56 are engaged between the channel flange 58 and the vertically extending edge of sole member 44, so that it is exceptionally firmly retained without special fastenings.

The raceway channel terminates short of each end of the associated wall structure and the cable 62 is passed between adjacent wall structures end-abutting at right angles to one another by means of a bridge member 64 providing its own bridge channel 66 and triangular attachment part 68 by which the channel is mounted in the corner extending at approximately 45° to each of the wall structures. This bridging channel opens upwards and it and the attachment part are provided with horizontal flanges 70 on which is mounted a horizontal cover plate 72 closing the channel. A cable passing in the channels 58 and 66 can be joined at any point therein as indicated by reference 74, and still meet code requirements, since they are complete enclosures. A cable 76 which runs vertically from a junction with the horizontal cable 62 is passed through suitable cutouts in the edge of the channel, the material being sufficiently thin to be cut easily by shears or a punch. A grommet 78 of conventional form is used where the cable passes across a metal edge.

We claim:

1. A building wall structure comprising:

a. a wall frame providing an internal vertical face to which a sheet member is applied to close the frame and provide a corresponding internal wall surface;

b. the wall frame being constituted by a horizontal sole member, a spaced parallel horizontal head member, and parallel vertical stud members extending between and connecting the head and sole members;

c. a channel member having a C cross-section and mounted within the said wall frame;

d. the channel member having the lower leg thereof fastened to the sole member and the open face of the channel opening to the said internal vertical face of the wall frame;

e. the said sheet member applied to the said wall frame internal vertical face also closing the open face of the channel so that the channel and the adjacent portion of the panel member constitute a closed raceway for electric wiring;

f. wherein the raceway channels of two wall structures abutting at right angles to one another terminate short of the respective abutting edges of the wall structures;

g. there is provided a bridging member for conveying electrical wiring between the two raceway channels comprising an upwardly-opening channel extending between the two wall structues at approximately 45° to each structure; and h. wherein the bridging channel member is supported in the structure by a triangular support member fastened to the bridging channel member and to both wall structures, the support member receiving and supporting a cover plate for closing the bridging channel member.

2. A building wall structue comprising:

a. two vertically-superimposed walls each having an inner and an outer face;

b. a deck member having at an edge thereof a horizontal flange interposed between the two walls and two spaced vertical flanges connected to the horizontal flange, the two vertical flanges being disposed on opposite sides of the upper of the two vertically superimposed walls and extending vertically upwards alongside respectively the inner and outer faces thereof;

c. each wall comprising a wall frame providing an internal vertical face to which a sheet member is applied to close the frame and provide a corresponding internal wall surface;

d. the wall frame being constituted by a horizontal sole member, a spaced parallel horizontal head member, and parallel vertical stud members extending between and connecting the head and sole members;

e. a channel member having a C cross-section and mounted within the said wall frame;

f. the channel member having the lower leg thereof fastened to the sole member and the open face of the channel opening to the said internal vertical face of the wall frame;

g. the said sheet member applied to the said wall frame internal vertical face having its lower edge interposed beteen the vertically-upwardly-extending flange that extends alongside the inner wall face and the adjacent part of the wall frame internal vertical face, the sheet member also closing the open face of the channel so that the channel and the adjacent portion of the panel member constitute a closed raceway for electric wiring; and h. the last-mentioned vertical flange being of sufficient depth to overlap the open face of the channel member.

* * * * *